US006523449B2

(12) United States Patent
Fayard et al.

(10) Patent No.: US 6,523,449 B2
(45) Date of Patent: Feb. 25, 2003

(54) PERFORATING GUN

(75) Inventors: Alfredo Fayard, Sugar Land, TX (US); Haoming Li, Missouri City, TX (US); Robert A. Parrott, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/760,515

(22) Filed: Jan. 11, 2001

(65) Prior Publication Data

US 2002/0088338 A1 Jul. 11, 2002

(51) Int. Cl.[7] ..... F41F 5/00; H64D 1/04

(52) U.S. Cl. ..... 89/1.15; 166/297; 166/299; 166/63; 175/4.51; 175/4.55; 175/4.57; 102/310; 102/311; 102/312; 102/313; 102/320

(58) Field of Search ..... 89/1.15; 102/310; 175/4, 4.51

(56) References Cited

U.S. PATENT DOCUMENTS 3,739,723 A * 6/1973 Hakala
3,951,218 A * 4/1976 Sjogren
4,326,462 A * 4/1982 Garcia et al.
4,428,440 A * 1/1984 McPhee
4,496,009 A * 1/1985 DerMott et al. ..... 102/310
4,519,313 A * 5/1985 Leidel
4,744,424 A 5/1988 Lendermon et al.
4,844,170 A * 7/1989 Gill
4,960,171 A 10/1990 Parrott et al.
5,033,553 A 7/1991 Miszewski et al.
5,054,564 A 10/1991 Oestreich et al.
5,392,857 A * 2/1995 Behrmann
5,477,785 A * 12/1995 Dieman et al. ..... 102/313
5,505,134 A 4/1996 Brooks et al.
5,673,760 A * 10/1997 Brooks et al.
6,125,946 A * 10/2000 Chen
6,298,915 B1 * 10/2001 George

* cited by examiner

*Primary Examiner*—Michael J. Carone
*Assistant Examiner*—Troy Chambers
(74) *Attorney, Agent, or Firm*—Trop, Pruner & Hu, P.C.; Jeffery E. Griffin; Briqitte L. Jeffery

(57) ABSTRACT

A technique includes arranging perforating charges of a perforating gun into groups of adjacent perforating charges. Each perforating charge of each group is aligned in a direction associated with the group. The groups are oriented to form a phasing for the perforating gun.

22 Claims, 1 Drawing Sheet

PERFORATING GUN

BACKGROUND

The invention generally relates to a perforating gun.

For purposes of enhancing production from a subterranean formation, a perforating gun typically is lowered down into a wellbore (that extends through the formation), and radially oriented shaped charges (of the perforating gun) are detonated to form perforations in the formation. The shaped charges typically are placed at points along a helical spiral that extends around a longitudinal axis of the perforating gun. The angular displacement (with respect to the longitudinal axis) between the adjacent charges along this path defines a phasing of the gun. Typically, specified parameters, such as a shot density and the phasing, control the number of shaped charges of the gun, the angular positions of the shaped charges and the distances along the longitudinal axis between the shaped charges.

For example, FIG. 1 depicts a carrier tube-type perforating gun 10 that includes shaped charges 14 (charges 14*a*, 14*b* and 14*c* depicted as examples) that are alternatively phased (relative to each other) at 0° and 180° about the longitudinal axis of the gun 10, i.e., the shaped charges are phased 180° apart. In this manner, the top charge 14*a* of the perforating gun 10 in FIG. 1 is positioned at 0° (as a reference point), the middle charge 14*b* is positioned at 180° and the bottom charge 14*c* is positioned at 0°. Thus, each adjacent pair of charges 14 is phased differently (at 0° and 180°). The charges 14 are housed inside a hollow carrier tubing 11, and a detonating cord 12 extends between and is connected to the charges 14 to communicate a detonating wave to the charges 14. Although a carrier tube-type perforating gun is depicted in FIG. 1, another structure may hold and orient the charges 14, such as a strip (in a strip-type perforating gun) to which the ends of the charges 14 are connected.

A distance (called "d" in FIG. 1) between adjacent charges 14 governs the shot density of the perforating gun 10. Thus, to increase the shot density of the perforating gun 10, the distance d is decreased, and to decrease the shot density of the gun 10, the distance d is increased. However, factors limit the maximum shot density of the gun 10. For example, the closer the adjacent charges 14 are together (i.e., the smaller the distance d), the more the detonating cord 12 bends between the charges 14, a factor that increases a cord-to-charge interference between the detonating cord 12 and the charges 14. Furthermore, if there is interference between the charges 14, the closer the adjacent charges 14, the greater the charge-to-charge interference between the charges 14. In this manner, charges 14 that have opposite phases typically significantly interfere with each other when the charges 14 are placed too close together.

Thus, there is a continuing need for an arrangement that addresses one or more of the problems that are stated above.

SUMMARY

In one embodiment, a technique includes arranging perforating charges of a perforating gun into groups of adjacent perforating charges. Each perforating charge of each group is aligned in a single direction associated with the group. The groups are oriented to form a phasing for the perforating gun.

Other embodiments and features will become apparent from the following description, from the drawings, and from the claims.

DETAILED DESCRIPTION

Figure 1:
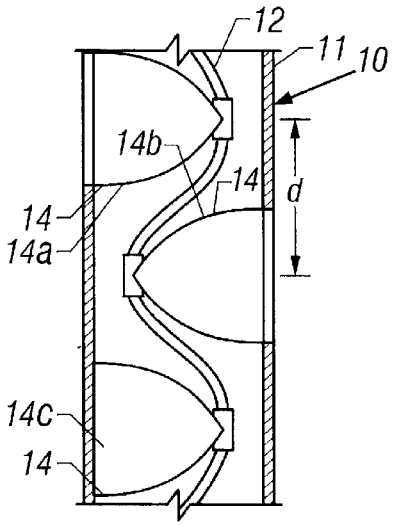
FIG. 1 (Prior Art)
FIG. 1 is a schematic diagram of a carrier tube-type perforating gun of the prior art.
Figure 2:
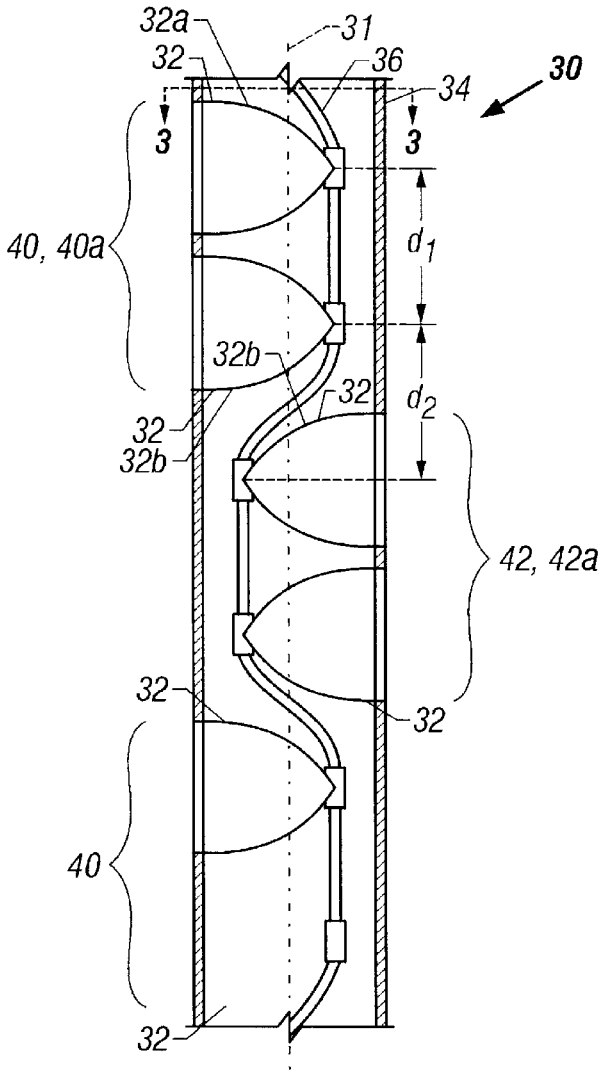
FIG. 2 is a schematic side view of a carrier tube-type perforating gun according to an embodiment of the invention.

Referring to FIG. 2, an embodiment 30 of a carrier tube-type perforating gun in accordance with the invention includes perforating charges, such as shaped charges 32, that are arranged to establish a particular phasing for the gun 30. Unlike conventional perforating guns, the shaped charges 32 of the perforating gun 30 are organized into groups of adjacent shaped charges 32, with the perforating charges of each group being oriented in the same direction (i.e., the perforating charges of each group have the same angular position about a longitudinal axis 31 of the gun 30). Thus, each shaped charge of a conventional perforating gun is effectively replaced by a group of one or more adjacent shaped charges 32.

Figure 3:
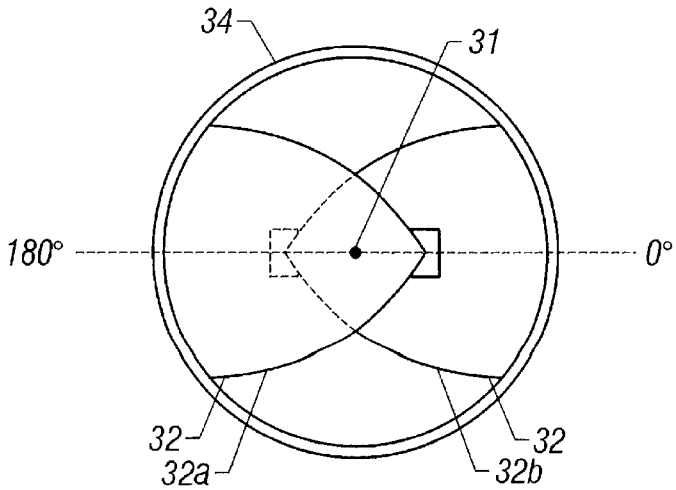
FIG. 3 is a cross-sectional view of the perforating gun taken along line 3—3 of FIG. 2.

More specifically, the perforating gun 30 has groups of shaped charges 32 that are placed at points along a helical spiral that extends around the longitudinal axis 31 of the gun 30. For the perforating gun 30 that is depicted in FIG. 2, the phase angle between adjacent groups along this spiral is 180°, and as a result, the groups may be divided into groups 40 (group 40*a* depicted as an example) that are associated with a 180° phase and groups 42 (group 42*a* depicted as an example) that are associated with a 0° phase. As an example, FIG. 3 depicts the group 40*a* (having the top shaped charge 32*a*) and its relationship to the group 42*a* (having the top shaped charge 32*b*). As shown, the group 40*a* points in a direction that is 180° away from the direction pointed to by the group 42*a*. Thus, referring back to FIG. 2, the groups 40 are interleaved with the groups 42 along the longitudinal axis of the perforating gun 30. Although FIGS. 2 and 3 illustrate each group (40 and 42) as having two shaped charges 32, it is understood that each group (40 and 42) may consist of one or more shaped charges 32 and that each group (40 and 42) may have a different number of shaped charges 32.

Still referring to FIG. 2, because of the above-described grouping of adjacent shaped charges 32 that have the same orientation, a distance (called $d_1$) between adjacent shaped charges 32 having the same phase may be reduced, as compared to this distance in conventional 0° and 180° perforating guns. Because of the reduction in the $d_1$ distance between shaped charges 32 of each group 40, 42, a distance (called "$d_2$" in FIG. 2) between shaped charges 32 that have opposite phases may be increased, as compared to conventional perforating guns. This spacing arrangement decreases the charge-to-charge interference between charges 32 of the opposite phases. In this manner, for a given distance between adjacent charges, the charge-to-charge interference is less if the shaped charges 32 have the same phase than if the charges 32 have opposite phases. Therefore, the perforating gun 30 may be designed with the desired shot density while minimizing interferences between the charges, as compared to conventional perforating guns.

The grouping of the charges 32 also introduces less winding (as compared to conventional perforating guns having the same shot density) in a detonating cord 36 that extends between and is connected to the shaped charges 32 to communicate a detonating wave. Thus, the detonating cord 36 is generally straighter between charges 32 that have opposite phases, as more distance exists between these charges 32. As a result, the average distance between the detonating cord 46 and the shaped charges 32 of different groups (40 and 42) is larger thereby providing less cord-to-charge interference, as compared to conventional perforating guns having the same shot density.

Other embodiments are within the scope of the following claims. For example, the perforating gun 30 is depicted in FIG. 2 as being a carrier tube-type perforating gun, a gun that includes a hollow carrier tube 34 to hold the shaped charges 32 in the orientations described above. However, the perforating gun may be a strip-type perforating gun (in some embodiments of the invention), a gun that includes a long strip to which the non firing ends of the shaped charges 32 are mounted. The perforating gun may have a phasing other than 180° phasing, in some embodiments of the invention. For example, the shaped charges may be arranged in groups and each group may be phased by an angle less than 180° from the adjacent group along the helical spiral.

In the preceding description, directional terms, such as "upper," "lower," "vertical" and "horizontal," may have been used for reasons of convenience to describe the perforating gun and its associated components. However, such orientations are not needed to practice the invention, and thus, other orientations are possible in other embodiments of the invention.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A method comprising:

providing a perforating gun comprising a longitudinal segment and perforating charges along the longitudinal segment;

arranging all perforating charges along the longitudinal segment of the perforating gun into groups of adjacent perforating charges, each perforating charge of each group being aligned in a single direction associated with the group and at least one of the group and at least two of the perforating charges;

establishing a smaller distance between adjacent perforating charges of the same group than another distance between adjacent perforating charges of different groups; and orienting the groups to form a phasing for the perforating gun.

2. The method of claim 1, wherein the orienting the groups comprises:

orienting the groups to orient the associated directions at one hundred eighty degrees and zero degrees about a longitudinal axis of the gun.

3. The method of claim 2, further comprising:

interleaving the groups that are associated with directions oriented at zero degrees with the groups that are associated with directions oriented at one hundred eighty degrees.

4. The method of claim 1, further comprising:

spacing the perforating charges along the longitudinal axis of the perforating gun.

5. The method of claim 1, wherein at least one of the groups comprises at least two of the perforating charges.

6. The method of claim 1, wherein each of the groups includes at least two of the perforating charges.

7. A method comprising:

providing a perforating gun comprising a longitudinal segment and perforating charges along the longitudinal segment;

spacing the perforating charges along a longitudinal axis of the longitudinal segment of the perforating gun, the spacing comprising establishing a smaller distance between adjacent perforating charges of the same group than another distance between adjacent perforating charges of different groups;

organizing all of the perforating charges along the longitudinal segment into groups, each group comprising a plurality of the perforating charges oriented near an associated common angular position for the group about the longitudinal axis and each perforating charge of each group being adjacent along the longitudinal axis to another perforating charge of said each group; and orienting the groups about the longitudinal axis to form a predetermined phasing for the perforating gun.

8. The method of claim 7, wherein the orienting the groups comprises:

orienting the groups to orient the associated common angular positions at one hundred eighty degrees and zero degrees.

9. The method of claim 7, wherein at least one of the groups comprises two of the perforating charges.

10. The method of claim 7, wherein each of the groups includes at least two of the perforating charges.

11. A method comprising:

providing a perforating gun comprising a longitudinal segment and perforating charges along the longitudinal segment;

arranging all perforating charges along the longitudinal segment of the perforating gun into first and second groups of adjacent perforating charges, each perforating charge of each first group having an orientation about the longitudinal axis of the gun near zero degrees and each perforating charge of each second group having an orientation about the longitudinal axis of the gun near one hundred eighty degrees, at least one of the first and second groups comprising at least two of the perforating charges;

establishing a smaller distance between adjacent perforating charges of the first group than another distance between adjacent perforating charges of the first and second groups; and interleaving the first groups with the second groups along the longitudinal axis of the perforating gun.

12. The method of claim 11, further comprising:

establishing a smaller distance between adjacent perforating charges of the second group than another distance between adjacent perforating charges of the first and second groups.

13. A perforating gun comprising:

a longitudinal segment comprising perforating charges, wherein all of the perforating charges of the longitudinal segment are arranged in groups, each perforating charges of each group is aligned in a direction associated with the group and at least one of the groups comprises at least two of the perforating charges; and a mechanism to hold the perforating charges and orient the groups to form a phasing for the perforating gun, wherein smaller distances exist between adjacent perforating charges of the same group than other distances between adjacent perforating charges of different groups.

14. The perforating gun of claim 13, wherein the mechanism orients the associated directions of the groups at one hundred eighty degrees and zero degrees about a longitudinal axis of the gun.

15. The perforating gun of claim 14, wherein the groups that are associated with directions oriented at zero degrees are interleaved with the groups that are associated with directions oriented at one hundred eighty degrees.

16. The perforating gun of claim 14, wherein the perforating charges are spaced along a longitudinal axis of the perforating gun.

17. The perforating gun of claim 13, wherein at least one of the groups comprises at least two of the perforating charges.

18. The perforating gun of claim 13, wherein each of the groups includes at least two of the perforating charges.

19. A perforating gun comprising:

a longitudinal segment comprising perforating charges;

arranging all perforating charges of the longitudinal segment into first and second groups of adjacent perforating charges, each perforating charge of each first group having an orientation about the longitudinal axis of the gun near zero degrees and each perforating charge of each second group having an orientation about the longitudinal axis of the gun near one hundred eighty degrees, at least one of the first and second groups comprising at least two of the perforating charges; and a mechanism to hold the perforating charges and interleave the first groups with the second groups along the longitudinal axis of the perforating gun, wherein smaller distance exist between adjacent perforating charges of the same group than other distances between adjacent perforating charges of different groups.

20. The perforating gun of claim 19, wherein the perforating charges are spaced along the longitudinal axis of the perforating gun.

21. The perforating gun of claim 19, wherein at least one of the groups comprises at least two of the perforating charges.

22. The perforating gun of claim 19, wherein each of the groups includes at least two of the perforating charges.

* * * * *